US008954242B2

(12) United States Patent
Miyasaka

(10) Patent No.: US 8,954,242 B2
(45) Date of Patent: Feb. 10, 2015

(54) WHEEL LOADER AND CONTROL METHOD OF WHEEL LOADER

(71) Applicant: Komatsu Ltd., Minato-ku, Tokyo (JP)

(72) Inventor: Hisashi Miyasaka, Komatsu (JP)

(73) Assignee: Komatsu Ltd., Tokyo (JP)

( * ) Notice: Subject to any disclaimer, the term of this patent is extended or adjusted under 35 U.S.C. 154(b) by 62 days.

(21) Appl. No.: 13/823,362

(22) PCT Filed: Sep. 19, 2012

(86) PCT No.: PCT/JP2012/073868

§ 371 (c)(1),
(2) Date: Mar. 14, 2013

(87) PCT Pub. No.: WO2013/190715

PCT Pub. Date: Dec. 27, 2013

(65) Prior Publication Data

US 2014/0058649 A1 Feb. 27, 2014

(30) Foreign Application Priority Data

Jun. 22, 2012 (JP) ..... 2012-140515

(51) Int. Cl.
*E02F 9/20* (2006.01)
*F02D 29/04* (2006.01)
(Continued)

(52) U.S. Cl.
CPC ..... *F02D 29/04* (2013.01); *F02D 41/0205* (2013.01); *F02D 41/021* (2013.01);
(Continued)

(58) Field of Classification Search
CPC ..... E02F 9/2246
USPC ..... 701/50
See application file for complete search history.

(56) References Cited

U.S. PATENT DOCUMENTS 4,697,418 A * 10/1987 Okabe et al. ..... 60/434
4,792,052 A * 12/1988 Okuda et al. ..... 212/287
(Continued)

FOREIGN PATENT DOCUMENTS

EP 1 331 383 A1 7/2003
EP 2 444 636 A1 4/2012
(Continued)

OTHER PUBLICATIONS

JPO machine translation of JP 2010-223416 (original JP document published Oct. 7, 2010).*
(Continued)

*Primary Examiner* — Behrang Badii
*Assistant Examiner* — David Testardi
(74) *Attorney, Agent, or Firm* — Global IP Counselors, LLP

(57) ABSTRACT

A wheel loader includes a vehicle body frame, an engine, a working unit including a boom and a bucket, a cab accommodating therein an operator seat, a boom operating member an operating member that switches forward/rearward travelling, a first sensor configured and arranged to detect that the operating member is located in a neutral position, and a second sensor configured and arranged to detect that the boom has been operated. An engine control unit is configured to limit a maximum rotation speed of the engine to a predetermined rotation speed when the operating member for switching of forward/rearward travelling is located in the neutral position and the boom operating member has been operated.

6 Claims, 4 Drawing Sheets

(51) Int. Cl.

| | |
|---|---|
| ***F02D 41/02*** | (2006.01) |
| ***F02D 29/00*** | (2006.01) |
| ***F02D 31/00*** | (2006.01) |
| ***E02F 9/22*** | (2006.01) |
| ***E02F 3/34*** | (2006.01) |

(52) U.S. Cl.

CPC ..... *F02D 29/00* (2013.01); *F02D 31/009* (2013.01); *E02F 9/2246* (2013.01); *E02D 31/001* (2013.01); *E02F 3/3411* (2013.01); *E02F 9/2066* (2013.01)

USPC ..... 701/50

(56) References Cited

U.S. PATENT DOCUMENTS

| | | | | | |
|---|---|---|---|---|---|
| 5,077,973 | A * | 1/1992 | Suzuki et al. | ..... | 60/428 |
| 5,277,269 | A * | 1/1994 | Ichimura et al. | ..... | 180/306 |
| 5,586,536 | A * | 12/1996 | Seo et al. | ..... | 123/352 |
| 5,638,677 | A * | 6/1997 | Hosono et al. | ..... | 60/431 |
| 5,911,506 | A * | 6/1999 | Nakamura et al. | ..... | 37/348 |
| 5,930,996 | A * | 8/1999 | Nakamura et al. | ..... | 60/426 |
| 5,999,872 | A * | 12/1999 | Kinugawa et al. | ..... | 701/50 |
| 6,234,254 | B1 * | 5/2001 | Dietz et al. | ..... | 172/3 |
| 6,277,050 | B1 * | 8/2001 | Nakagawa et al. | ..... | 477/112 |
| 7,273,124 | B2 * | 9/2007 | Tatsuno et al. | ..... | 180/305 |
| 7,533,527 | B2 * | 5/2009 | Naruse | ..... | 60/433 |
| 7,543,448 | B2 * | 6/2009 | Nakamura et al. | ..... | 60/434 |
| 7,631,495 | B2 * | 12/2009 | Naruse | ..... | 60/426 |
| 7,959,538 | B2 * | 6/2011 | Hatanaka | ..... | 477/187 |
| 8,463,509 | B2 * | 6/2013 | Saito | ..... | 701/50 |
| 8,510,002 | B2 * | 8/2013 | Sakai et al. | ..... | 701/52 |
| 8,567,186 | B2 * | 10/2013 | Hyodo et al. | ..... | 60/431 |
| 2011/0308879 | A1 * | 12/2011 | Shirao et al. | ..... | 180/306 |

FOREIGN PATENT DOCUMENTS

| | | | | | |
|---|---|---|---|---|---|
| JP | 63-241226 | A | | 10/1988 | |
| JP | 9-32596 | A | | 2/1997 | |
| JP | 2000-136739 | A | | 5/2000 | |
| JP | 2000-303872 | A | | 10/2000 | |
| JP | 2005-256595 | A | | 9/2005 | |
| JP | 2007113304 | A | * | 5/2007 | |
| JP | 2010223416 | A | * | 10/2010 | |
| JP | 2011-157931 | A | | 8/2011 | |
| JP | 2012-52457 | A | | 3/2012 | |
| WO | WO 2010109972 | A1 | * | 9/2010 | ..... F16H 61/468 |
| WO | 2010/147232 | A1 | | 12/2010 | |
| WO | 2011/145684 | A1 | | 11/2011 | |

OTHER PUBLICATIONS

JPO machine translation of JP 2007-113304 (original JP document published May 10, 2007).*

The extended European search report for the corresponding European application No. 12842692.1, issued on Feb. 26, 2014.

International Search Report of corresponding PCT Application No. PCT/JP2012/073868, (Oct. 2012).

* cited by examiner

WHEEL LOADER AND CONTROL METHOD OF WHEEL LOADER

CROSS-REFERENCE TO RELATED APPLICATIONS

This application claims priority to Japanese Patent Application No. 2012-140515 filed on Jun. 22, 2012, the disclosure of which is hereby incorporated herein by reference in its entirety.

TECHNICAL FIELD

The present invention relates to a wheel loader and a control method of a wheel loader.

BACKGROUND ART

In general, such works as excavation are executed by wheel loaders in which an operating lever and etc. are operated while a fuel control lever is set in a maximum rotation position. In such a work condition, vibrations during travelling and unavoidable vibrations in such work as excavation are generated, and accordingly, vibrations attributed to engine rotation are supposed to be smaller relatively thereto. Therefore, vibrations attributed to engine rotation do not make an operator feel uncomfortable.

On the other hand, works are often executed while travelling is stopped and simultaneously the engine rotation speed is set to be the maximum rotation speed, for instance, when earth, sand and etc. are excavated and then loaded on a dump truck or the like by operating a boom. Therefore, vibrations attributed to engine rotation are increased. Further, there is herein no external factor related to vibrations. Accordingly, vibrations attributed to engine rotation make an operator feel uncomfortable in such condition.

Now, an engine control device as described in Japan Laid-open Patent Application Publication No. JP-A-2000-303872 has been proposed for inhibiting vibrations in a construction machine. In the device, the engine rotation speed is firstly set to be a first lower rotation speed higher than a rotation speed at a maximum resonance point when an operation is not being executed for a work. Then, after elapse of a predetermined period of time, the engine rotation speed is set to be a second lower rotation speed that is further lower than the first rotation speed and is close to a rotation speed at an anti-resonance point. Thus, through the control of low idle rotation speed, resonance of the engine is avoided, and low fuel consumption and low noise generation are achieved.

On the other hand, a control device described in Japan Laid-open Patent Application Publication No. JP-A-H09-32596 is configured to automatically change the engine rotation speed into a rotation speed higher or lower than a preliminarily set specific rotation speed range when it is determined that the engine rotation speed falls in the specific rotation speed range. Accordingly, the engine is prevented from being operated in the specific rotation speed range with large noise and large vibrations, and dwelling comfort and durability of a vehicle are enhanced.

SUMMARY

The device of Japan Laid-open Patent Application Publication No. JP-A-2000-303872 is configured to inhibit vibrations by controlling the engine rotation speed to be lower than the rotation speed at the maximum resonance point. However, in a wheel loader, heavy components such as a boom and a bucket are mounted to the front part of the vehicle, and the rotation speed at the maximum resonance point varies in accordance with actuation states of the components. Further, the rotation speed at the maximum resonance point also varies in accordance with a condition of load acting on front and rear wheels. Therefore, it is difficult to constantly control the engine rotation speed to be lower than the rotation speed at the maximum resonance point.

On the other hand, the device of Japan Laid-open Patent Application Publication No. JP-A-H09-32596 is configured to automatically change the engine rotation speed to fall outside the specific rotation speed range. However, due to a reason similar to the aforementioned reason, the specific rotation speed range varies in accordance with conditions of the vehicle and the working unit. Therefore, it is also difficult in the device of Japan Laid-open Patent Application Publication No. JP-A-H09-32596 to constantly control the engine rotation speed not to fall in the specific rotation speed range.

It should be noted that vibrations attributed to engine rotation can be inhibited by limiting the maximum rotation speed of the engine. However, when the maximum rotation speed of the engine is simply limited, the discharge amount of a pump is reduced and drawbacks are accordingly produced, including delay in motion of the working unit and shortage of lubricating oil.

It is an object of the present invention to inhibit vibrations attributed to engine rotation and thereby inhibit uncomfortable vibrations felt by an operator without deteriorating workability through a simple engine control.

A wheel loader according to a first aspect of the present invention includes a vehicle body frame, an engine installed in the vehicle body frame, a working unit, a cab, a first sensor, a second sensor and an engine control unit. The working unit includes a boom and a bucket mounted to a front end of the boom and is disposed forwards of the vehicle body frame. The cab accommodates therein an operator seat, a boom operating member for operating the boom and an operating member for switching of forward/rearward travelling. The first sensor detects that the operating member for switching of forward/rearward travelling is located in a neutral position. The second sensor detects that the boom has been operated. The engine control unit is configured to limit a maximum rotation speed of the engine to a predetermined rotation speed when the operating member for switching of forward/rearward travelling is located in the neutral position and the boom operating member has been operated.

As described above, in travelling or executing a work such as excavation, vibrations attributed to engine rotation do not herein make an operator feel uncomfortable because vibrations attributed to the other reasons are greater than those attributed to engine rotation. However, in loading earth, sand and etc. onto a dump truck or etc. by operating a boom, for instance, vibrations attributed to engine rotation make an operator feel uncomfortable because there exists no external reason for vibrations.

In view of the above, the present device is configured to detect such situation that vibrations attributed to engine rotation make an operator feel uncomfortable, and is configured to control the engine rotation speed in such situation. Specifically, the first sensor detects that the operating member for switching of forward/rearward travelling is located in the neutral position, whereas the second sensor detects that the boom has been operated. In other words, it is detected that the working unit has been operated in such a condition that the vehicle is stopped or the vehicle is travelling at a lower speed by means of inertia. In such situation, the maximum rotation speed of the engine is limited to a predetermined rotation speed.

The maximum rotation speed of the engine is herein configured to be limited when a situation is produced that vibrations attributed to engine rotation makes an operator feel uncomfortable. Therefore, it is possible to inhibit reduction in working efficiency and inhibit an operator from feeling uncomfortable, compared to a case that the engine rotation speed is simply inhibited.

A wheel loader according to a second aspect of the present invention relates to the wheel loader of the first aspect, and further includes a third sensor detecting an operation angle of the boom. Further, the engine control unit is configured to limit the maximum rotation speed of the engine to the predetermined rotation speed in accordance with the operation angle of the boom in addition to when the operating member for switching of forward/rearward travelling is located in the neutral position and the boom operating member has been operated.

It should be noted that "the boom operation angle" is an angle θ formed between a horizontal direction and a line connecting a boom pin P1 and a bucket pin P2 where the horizontal direction is set as an angle of 0 degrees in a side view as illustrated in FIG. 4. A downward angle from the horizontal direction is set to have a negative value while an upward angle from the horizontal direction is set to have a positive value. Therefore, the boom operation angle is defined to be increased upwards.

Here, uncomfortable vibrations can be more effectively inhibited by detecting the operation angle of the boom and thereby controlling the engine rotation speed.

A wheel loader according to a third aspect of the present invention relates to the wheel loader of the second aspect, and wherein the engine control unit is configured to limit the maximum rotation speed of the engine to the predetermined rotation speed when the operating member for switching of forward/rearward travelling is located in the neutral position and the operation angle of the boom became an angle indicating separation of a bottom plate of the bucket from the ground as a result of an operation of the boom.

Here, under the condition that the bottom plate of the bucket makes contact with the ground, the vehicle body is stabilized and vibrations of the vehicle body can be inhibited. However, when the bucket is separated away from the ground, vibrations are easily produced due to the forwardly protruded working unit. The wheel loader tends to shake back and forth about front wheels, especially because the wheel loader is a vehicle of a travelling wheel type.

In view of the above, the wheel loader of the third aspect is configured to detect that the bucket has been separated away from the ground by detecting the operation angle of the boom and thereby control the engine rotation speed. Accordingly, it is possible to more effectively inhibit an operator from feeling uncomfortable.

A wheel loader according to a fourth aspect of the present invention relates to the wheel loader according to any of the first to third aspects, and further includes a vehicle speed detecting unit detecting a vehicle speed. Further, the engine control unit is configured to limit the maximum rotation speed of the engine to the predetermined rotation speed when the vehicle speed is less than or equal to a predetermined value.

In some types of work, an inertia travelling state is produced by switching the operating member for switching of forward/rearward travelling into the neutral position in the course of travelling, and a work is executed under the condition. When the maximum rotation speed of the engine is limited even in such case, work efficiency will be deteriorated.

In view of the above, the wheel loader of the fourth aspect is configured to limit the maximum rotation speed of the engine only when the operating member for switching of forward/rearward travelling is located in the neutral position and the vehicle speed is less than or equal to a predetermined value. Therefore, deterioration in work efficiency can be further inhibited.

A wheel loader according to a fifth aspect of the present invention relates to the wheel loader according to any of the first to fourth aspects, and further includes a mode switching control unit. The mode switching control unit is configured to switch an output mode of the engine between a power mode for using the engine at a first horse power and an economy mode for using the engine at a second horse power less than the first horse power. Further, the engine control unit is configured to limit the maximum rotation speed of the engine to the predetermined rotation speed when the output mode of the engine has been switched into the power mode.

Some wheel loaders have a power mode with an emphasis on workability and an economy mode with an emphasis on fuel consumption as the output mode of the engine. In the power mode, the maximum rotation speed of the engine is set to be a relatively high rotation speed, and thereby, vibrations attributed to engine rotation are large. However, in the economy mode, the maximum rotation speed of the engine is limited, and thereby, vibrations attributed to engine rotation are relatively small. Therefore, in the economy mode, uncomfortable vibrations attributed to engine rotation are small and it is not required to further limit the maximum rotation speed of the engine. Moreover, workability may be remarkably deteriorated when the maximum rotation speed of the engine is further limited in the economy mode.

In view of the above, the wheel loader of the fifth aspect is configured to limit the maximum rotation speed of the engine only when the output mode of the engine is set in the power mode. Therefore, it is possible to inhibit an operator from feeling uncomfortable, and further, inhibit workability from being remarkably deteriorated.

A wheel loader according to a sixth aspect of the present invention relates to the wheel loader of any of the first to fifth aspects, and further includes a bucket operating member for operating the bucket and a fourth sensor detecting that the bucket operating member has been operated. Further, the engine control unit is configured to limit the maximum rotation speed of the engine to the predetermined rotation speed when the bucket operating member has not been operated.

In some cases, the wheel loaders execute a work of rotating the bucket up and down at a plurality of times in a short cycle for removing earth, sand and etc. attached to the bucket. In executing such work, a relatively large engine output is required for driving the bucket.

In view of the above, the wheel loader according to the sixth aspect is configured to detect that the bucket has been operated by an operator, and is configured not to limit the maximum rotation speed of the engine in this case. In other words, the wheel loader is configured to detect that the bucket has not been operated and accordingly limit the maximum rotation speed of the engine. Therefore, work efficiency is not deteriorated in removing earth, sand and etc. attached to the bucket.

An engine control method for a wheel loader according to the present invention is a method of controlling an engine of a wheel loader including a vehicle body frame, an engine installed in the vehicle body frame, a working unit, a cab and an engine control unit. The working unit includes a boom and a bucket mounted to a front end of the boom and is disposed forwards of the vehicle body frame. The cab accommodates therein an operator seat, a boom operating member for operating the boom and an operating member for switching of forward/rearward travelling. The engine control unit is configured to control a rotation speed of the engine.

A maximum rotation speed of the engine is configured to be limited to a predetermined rotation speed based on receipt of a signal indicating that the operating member for switching of forward/rearward travelling is located in a neutral position and a signal indicating that the boom operating member has been operated.

In an engine control method for a wheel loader according to another aspect of the present invention, the signal indicating that the boom operating member has been operated is a signal indicating an operation angle of the boom.

Advantageous Effects of Invention

According to the present invention as described above, it is possible to inhibit vibrations attributed to engine rotation and thereby inhibit uncomfortable vibrations felt by an operator without deteriorating workability through a simple engine control.

DESCRIPTION OF THE EMBODIMENTS

Structure

Figure 1:
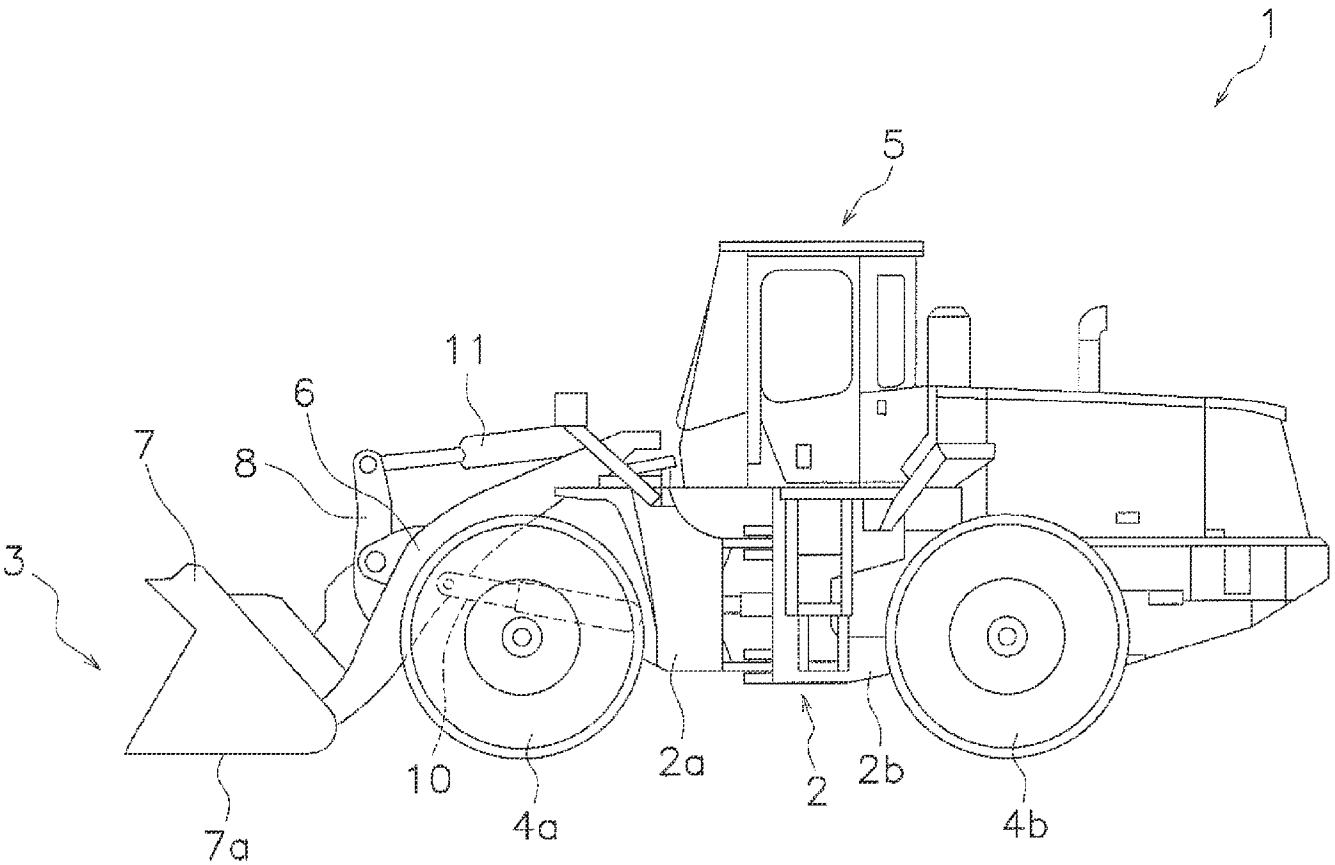
FIG. 1 is a side view of a wheel loader according to an exemplary embodiment of the present invention.
Figure 2:
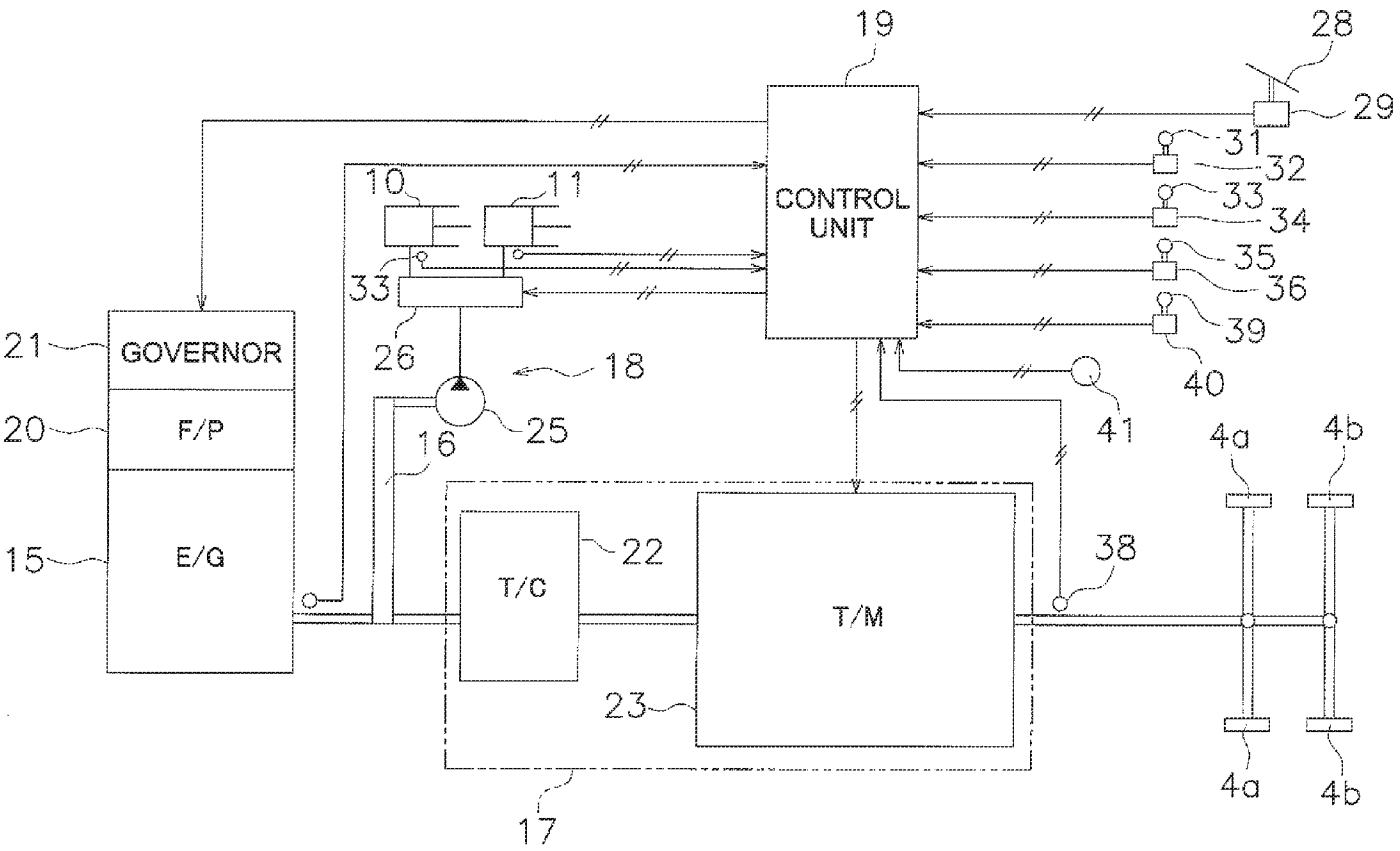
FIG. 2 is a schematic block diagram representing a configuration of the wheel loader.

FIG. 1 is an external view of a wheel loader 1 as a work vehicle, whereas FIG. 2 is a schematic configuration block diagram of the wheel loader 1. The wheel loader 1 includes a vehicle body frame 2, a working unit 3, front wheels 4*a*, rear wheels 4*b* and a cab 5. The wheel loader 1 can be self-propelled by driving and rotating the front wheels 4*a* and the rear wheels 4*b*. The wheel loader 1 can execute a desired work using the working unit 3.

The vehicle body frame 2 includes a front vehicle body part 2*a* and a rear vehicle body part 2*b*. The front vehicle body part 2*a* and the rear vehicle body part 2*b* are coupled while being pivotable in a right-and-left direction. The front vehicle body part 2*a* is provided with the working unit 3 and the front wheels 4*a*. The rear vehicle body part 2*b* is provided with the cab 5 and the rear wheels 4*b*. The working unit 3 is disposed forwards of the front vehicle body part 2*a* and includes a boom 6, a bucket 7, a bell crank 8 and etc. The boom 6 is configured to be pivoted up and down by means of a pair of lift cylinders 10. Further, the bucket 7 is attached to the tip of the boom 6. The bucket 7 is configured to be pivoted up and down by means of a bucket cylinder 11 through the bell crank 8.

As represented in FIG. 2, the wheel loader 1 further includes an engine 15, a power take-off unit 16, a power transmission mechanism 17, a cylinder driving unit 18 and a control unit 19.

The engine 15 is installed in the rear vehicle body part 2*b* and the output thereof is controlled by regulating the amount of fuel to be injected into a cylinder. The amount of fuel is regulated through the control of an electronic governor 21 attached to a fuel injection pump 20 of the engine 15 by the control unit 19.

The power take-off unit 16 is a device configured to divide and distribute the output of the engine 15 into the power transmission mechanism 17 and the cylinder driving unit 18.

The power transmission mechanism 17 is a mechanism configured to transmit the driving force from the engine 15 to the front wheels 4*a* and the rear wheels 4*b*. The power transmission mechanism 17 includes a torque converter 22 and a transmission 23. The transmission 23 includes a forward/rearward travelling clutch and a plurality of speed stage clutches corresponding to a plurality of speed stages. For example, the transmission 23 is provided with four speed stage clutches and the speed stages can be switched among four stages from a first speed to a fourth speed.

The cylinder driving unit 18 includes a hydraulic pump 25 and a control valve 26. The output of the engine 15 is transmitted to the hydraulic pump 25 through the power take-off unit 16. Further, the operating oil discharged from the hydraulic pump 25 is supplied to the lift cylinders 10 and the bucket cylinder 11 through the control valve 26.

The control unit 19 is formed by a microcomputer and is mainly configured to receive signals from the following sensors.

(1) An accelerator opening degree sensor 29 for detecting the opening degree of an accelerator pedal 28.

(2) A boom operation detecting sensor 32 (one example of a second sensor) for detecting that a boom operation lever 31 for operating the boom 6 has been operated.

(3) A position sensor 34 (one example of a first sensor) for detecting the position of a forward/rearward travelling switching lever 33.

(4) An output mode detecting sensor 36 for detecting the selected position of a selecting switch 35 for switching the output mode of the engine.

(5) An output shaft rotation speed sensor 38 of the transmission 23 as a vehicle speed sensor.

(6) A bucket operation detecting sensor 40 (one example of a fourth sensor) for detecting that a bucket operating member 39 for operating the bucket 7 has been operated.

(7) A boom operation angle detecting sensor 41 (one example of a third sensor) configured to detect the operation angle of the boom 6.

Figure 4:
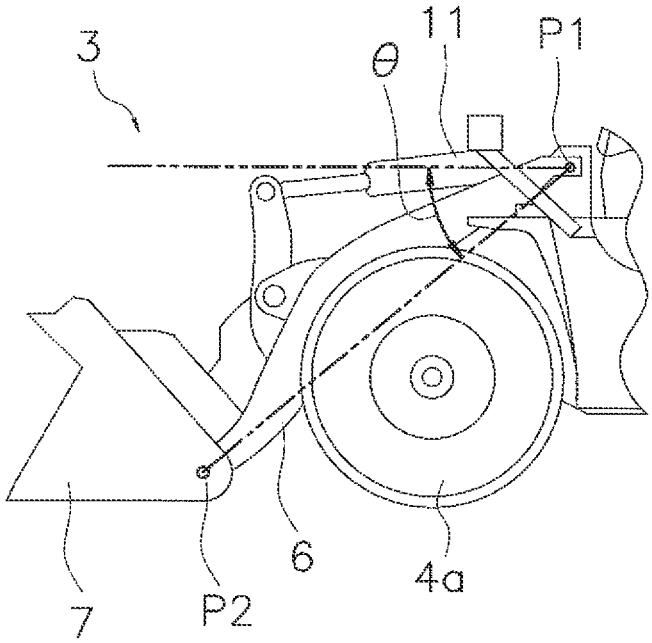
FIG. 4 is a diagram for explaining an operation angle of a boom.

It should be noted that, as described above, "the operation angle of the boom" is an angle θ formed between a horizontal direction and a line connecting the boom pin P1 and the bucket pin P2 where the horizontal direction is set as an angle of 0 degrees in a side view as illustrated in FIG. 4.

Further, based on signals from the aforementioned respective sensors, the control unit 19 is configured to execute a control of the rotation speed of the engine 15 and a control of limiting the maximum rotation speed, while being configured to execute a driving control of the cylinder driving unit 18, a gear-shifting control of the transmission 23 and etc.

It should be noted that the engine output mode selecting switch 35 is a switch configured to control switching of the output mode of the engine 15 between a power mode and an economy mode in response to an operator's operation. The power mode is a mode to be selected when a large engine output is required in travelling or execution of a work. On the other hand, the economy mode is a mode to be selected when the engine output is inhibited at a low level for achieving low fuel consumption. Such output mode control is executed for the engine 15 by controlling the upper limit of the amount of fuel to be injected into the engine 15.

Control of Maximum Rotation Speed of Engine

The control processing is herein configured to limit the maximum rotation speed of the engine for inhibiting vibrations to be increased in accordance with elevation of the engine rotation speed under a condition that an operator is liable to feel vibrations attributed to engine rotation. Through the control processing, uncomfortable feeling of an operator can be inhibited and comfortableness can be enhanced.

As a specific example that an operator feels vibrations attributed to engine rotation uncomfortable, such a condition can be considered that the engine rotation speed is set to be the maximum rotation speed and the boom 6 is elevated when the vehicle is stopped and waits for arrival of a dump truck while earth, sand and etc. are loaded on the bucket 7. Especially, a wheel loader is a vehicle of a travelling wheel type with a forwardly protruded working unit. Therefore, vibrations are easily generated when a bottom plate 7*a* of the bucket 7 is separated away from the ground.

Figure 3:
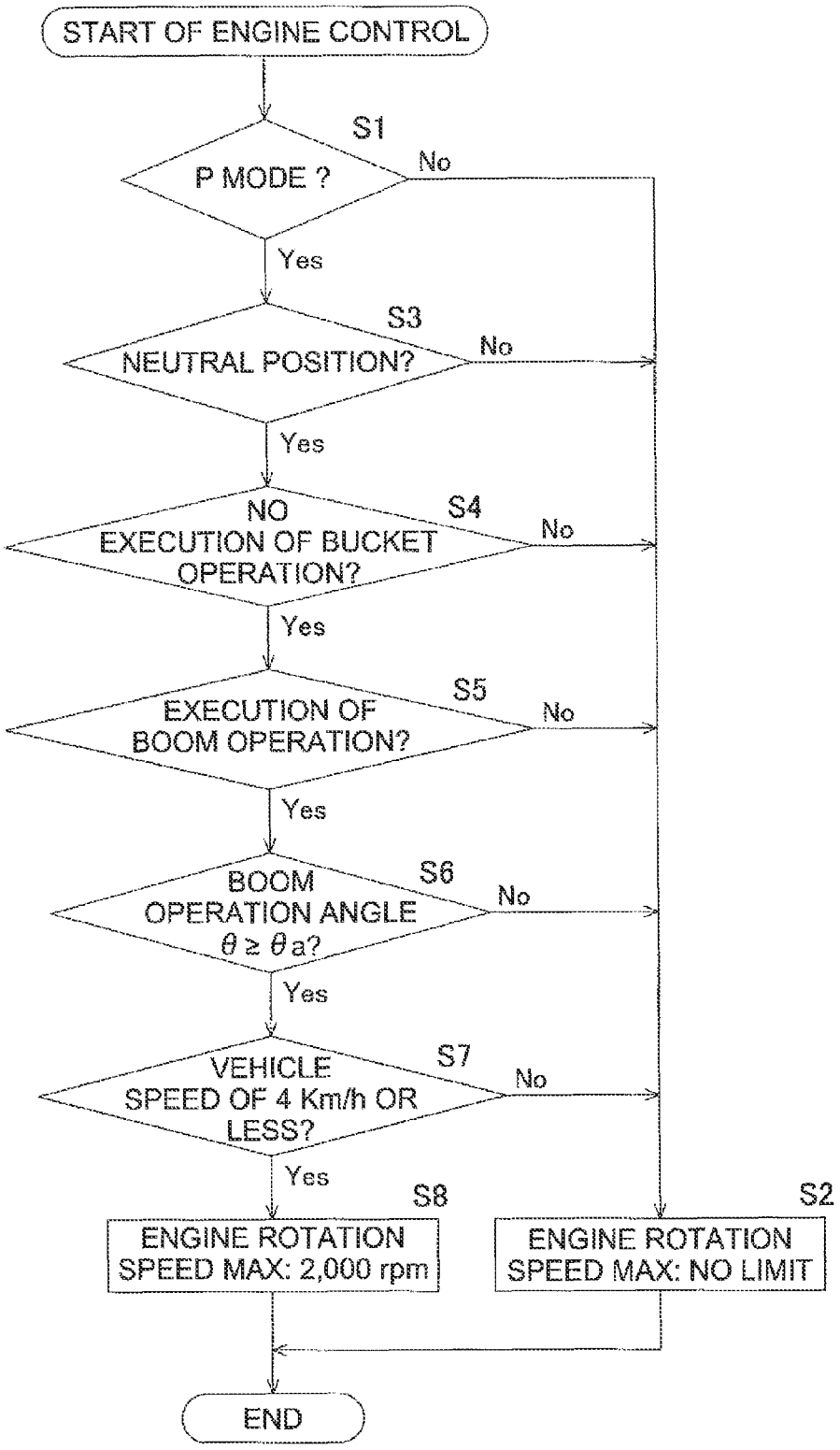
FIG. 3 is a flowchart for engine control.

FIG. 3 represents a flowchart of a processing of detecting a situation as described above and limiting the maximum rotation speed of the engine.

In FIG. 3, it is determined in Step S1 whether or not the power mode is being selected as the engine output mode. When the power mode is not being selected, i.e., when the economy mode is being selected, the maximum rotation speed of the engine is limited to, for instance, 2,000 rpm or less, In such economy mode, the engine rotation speed is not increased to 2,000 rpm or greater, and thereby, vibrations attributed to engine rotation are relatively small. Therefore, in such case, the processing proceeds from Step S1 to Step S2 and the engine control processing is not executed. In other words, the one set for the economy mode is herein used as the maximum rotation speed of the engine.

When the power mode is being selected as the engine output mode, the maximum rotation speed of the engine is set to be, for instance, 2,000 rpm or greater, and thereby, vibrations attributed to engine rotation get larger. Therefore, in such case, the processing proceeds from Step S1 to Step S3.

It is determined in Step S3 whether or not the forward/rearward travelling switching lever 33 has been operated and located in a neutral position. When the forward/rearward travelling switching lever 33 is located in a position other than the neutral position, the vehicle is travelling and the engine requires power. Therefore, limitation of the maximum rotation speed of the engine is not preferable. In view of this, when the forward/rearward travelling switching lever 33 is located in a position other than the neutral position, the processing proceeds from Step S3 to Step S2 and the engine control processing is terminated. Therefore, the one set for the power mode is used as the maximum rotation speed of the engine.

When the forward/rearward travelling switching lever 33 is located in the neutral position, the vehicle is stopped or travelling at a low speed by means of inertia. Therefore, the processing proceeds from Step S3 to Step S4. It is determined in Step S4 whether or not the bucket 7 has not been operated. As described above, in removing earth, sand and etc. attached to the bucket 7, the vehicle is stopped and an operation is executed for rotating the bucket 7 up and down in a short cycle. In this case, the engine requires power, and therefore, limitation of the maximum rotation speed of the engine is not preferable. Therefore, in such case, the processing proceeds from Step S4 to Step S2 and the engine control processing is not executed. In this case, similarly to the above, the one set for the power mode is used as the maximum rotation speed of the engine.

When the bucket 7 has not been operated, the processing proceeds from Step S4 to Step S5. It is determined in Step S5 whether or not the boom 6 has been operated. When the boom 6 has not been operated, the engine rotation speed is not set to be the maximum rotation speed. In this case, vibrations attributed to engine rotation are small. Therefore, the processing proceeds from Step S5 to Step S2 and the engine control processing is not executed.

Further, it is determined in Step S6 whether or not the operation angle θ of the boom 6 is greater than or equal to a threshold θa at which vibrations are easily generated. The threshold θa of the boom operation angle is herein set to be, for instance, "−30°". The threshold θa is set as follows.

In short, the operation angle of the boom 6 will be −45° to −40° when the boom 6 is lowered so that the bottom plate 7*a* of the bucket 7 makes contact with the ground. Based on this, the threshold θa is set as an operation angle in a state that the bottom plate 7*a* of the bucket 7 is reliably separated away from the ground, i.e., an operation angle of the boom 6 elevated at 5° to 10° from a position in the state that the bucket 7 makes contact with the ground. Therefore, an exemplary threshold θa is set to be "−30°".

When the operation angle of the boom 6 is less than or equal to −30°, it is determined that the bottom plate 7*a* of the bucket 7 is not being separated way from the ground. In this case, vibrations attributed to engine rotation are small. Therefore, the processing proceeds from Step S6 to Step S2 and the engine control processing is not executed.

The boom 6 is operated when earth, sand and etc. within the bucket 7 is loaded onto a dump truck. In this case, an operator often sets the maximum rotation speed for the engine to efficiently execute a work. Further, the bottom plate 7*a* of the bucket 7 is separated away from the ground. In such case, vibrations attributed to engine rotation are enlarged. In response, when the operation angle θ became θa or greater as a result of an operation of the boom 6, the processing proceeds from Step S6 to Step S7.

It is determined in Step S7 whether or not the vehicle speed is less than or equal to 4 km/h, for instance. In some work forms, the forward/rearward travelling switching lever may be located in the neutral position during travelling and a work may be executed while the vehicle is travelling by means of inertia. In such case, the engine requires power for driving the working unit and limitation of the maximum rotation speed of the engine is not preferable. Therefore, in such case that the vehicle speed exceeds 4 km/h, the processing proceeds from Step S7 to Step S2 and the engine control processing is not executed. In this case, similarly to the above, the one set for the power mode is used as the maximum rotation speed of the engine.

When the vehicle speed is, for instance, less than or equal to 4 km/h, this corresponds to a state that the vehicle is stopped or a state that the vehicle is travelling by means of inertia. In such case, vibrations attributed to engine rotation are enlarged when the engine rotation speed is increased to a preliminarily set maximum rotation speed. Further, the vibrations make an operator feel uncomfortable. In response, when the vehicle speed is less than or equal to 4 km/h, the processing proceeds from Step S7 to Step S8. In Step S8, the maximum rotation speed of the engine is controlled to be 2,000 rpm.

As described above, in the present control processing, the maximum rotation speed of the engine is limited where the following conditions are all satisfied.

The power mode is being selected as the engine output mode.

The forward/rearward travelling switching lever 33 is located in the neutral position.

The bucket 7 has not been operated.

The boom 6 has been operated, and thereby, the bottom plate 7*a* of the bucket 7 is separated away from the ground.

The vehicle speed is less than or equal to 4 km/h.

Then, through the aforementioned control processing, vibrations attributed to engine rotation can be inhibited and uncomfortable feeling felt by an operator can be inhibited.

Features (1) A complex control is not required because a type of situation making an operator feel uncomfortable is detected and the maximum rotation speed of the engine is limited in such situation. In addition, through the control processing, it is possible to constantly and effectively inhibit operator's uncomfortable feeling attributed to engine rotation regardless of specifications of the vehicles and etc. Further, the engine rotation speed is controlled without deteriorating workability. Therefore, deterioration in work efficiency can be prevented.

(2) The maximum rotation speed of the engine is not limited when a work is executed while the vehicle is travelling by means of inertia. Therefore, deterioration in work efficiency can be further avoided.

(3) The maximum rotation speed of the engine is configured to be limited only when the power mode is selected as the engine output mode. Therefore, execution of an unnecessary control can be prevented. Further, it is possible to prevent workability from being remarkably deteriorated in the economy mode.

(4) In executing a work of removing earth, sand and etc. attached to the bucket 7, the processing of limiting the maximum rotation speed of the engine is not executed as a result of detection of a bucket operation. Therefore, deterioration in work efficiency is not caused in removing earth, sand and etc. attached to the bucket 7.

Other Exemplary Embodiments

The present invention is not limited to the aforementioned exemplary embodiment and a variety of changes or modifications can be herein made without departing from the scope of the present invention.

In the aforementioned exemplary embodiment, whether or not the operation angle of the boom is greater than or equal to the threshold θa (Step S6 in FIG. 3) is exemplified as one of the conditions of limiting the maximum rotation speed of the engine. However, the condition may be excluded. In other words, when the boom is operated, the maximum rotation speed of the engine may be configured to be limited regardless of the operation angle of the boom.

In the aforementioned exemplary embodiment, the output shaft rotation speed sensor is provided as a sensor for detecting the vehicle speed. However, means for detecting the vehicle speed is not limited to this. For example, the vehicle speed may be obtained based on detection of an input shaft rotation speed and a gear stage of the transmission.

Further, numeric values represented in the aforementioned exemplary embodiment are exemplary only and the present invention is not limited to the numeric values.

According to a wheel loader of the illustrated embodiments, vibrations attributed to engine rotation can be inhibited and thereby uncomfortable vibrations felt by an operator can be inhibited without deteriorating workability through a simple engine control.

The invention claimed is:

1. A wheel loader comprising:

a vehicle body frame;

an engine installed in the vehicle body frame;

a working unit including a boom and a bucket mounted to a front end of the boom, the working unit being disposed forwards of the vehicle body frame;

a cab accommodating therein an operator seat, a boom operating member configured and arranged to operate the boom and an operating member configured and arranged to switch forward/rearward travelling;

a first sensor configured and arranged to detect that the operating member for switching of forward/rearward travelling is located in a neutral position;

a second sensor configured and arranged to detect that the boom operating member has been operated;

a third sensor configured and arranged to detect an operation angle of the boom, an engine control unit configured to execute a limitation control to limit a maximum rotation speed of the engine to a predetermined rotation speed in order to reduce vibrations in the wheel loader attributed to engine rotation in a power mode of the engine, the limitation control being executed when the following conditions are satisfied: a first condition that the operating member for switching of forward/rearward travelling is located in the neutral position and a second condition that the boom operating member has been operated such that the operation angle of the boom is an angle indicating separation of a bottom plate of the bucket from the ground.

2. The wheel loader recited in claim 1, further comprising a vehicle speed detecting unit configured and arranged to detect a vehicle speed, the engine control unit being configured to limit the maximum rotation speed of the engine to the predetermined rotation speed when a third condition that the vehicle speed is less than or equal to a predetermined value is satisfied in addition to the first and second conditions being satisfied.

3. The wheel loader recited in claim 1, further comprising a mode switching control unit configured to switch an output mode of the engine between the power mode for using the engine at a first horse power and an economy mode for using the engine at a second horse power less than the first horse power, wherein the engine control unit is configured to limit the maximum rotation speed of the engine to the predetermined rotation speed when an additional condition that the output mode of the engine has been switched into the power mode is satisfied in addition to the first and second conditions being satisfied.

4. The wheel loader recited in claim 1, further comprising:

a bucket operating member configured to operate the bucket; and a fourth sensor configured and arranged to detect that the bucket operating member has been operated, wherein the engine control unit is configured to limit the maximum rotation speed of the engine to the predetermined rotation speed when an additional condition that the bucket operating member has not been operated is satisfied in addition to the first and second conditions being satisfied.

5. An engine control method for a wheel loader, the wheel loader comprising:

a vehicle body frame;

an engine installed in the vehicle body frame;

a working unit including a boom and a bucket mounted to a front end of the boom, the working unit disposed forwards of the vehicle body frame;

a cab accommodating therein an operator seat, a boom operating member for operating the boom and an operating member for switching of forward/rearward travelling; and an engine control unit configured to control a rotation speed of the engine, the engine control method comprising:

limiting a maximum rotation speed of the engine to a predetermined rotation speed in order to reduce vibrations in the wheel loader attributed to engine rotation in a power mode of the engine upon receipt of a first signal indicating that the operating member for switching of forward/rearward travelling is located in a neutral position, a second signal indicating that the boom operating member has been operated, and a third signal indicating that an operation angle of the boom became an angle indicating separation of a bottom plate of the bucket from the ground.

6. The engine control method for a wheel loader according to claim 5, further comprising detecting a fourth signal indicating an output mode of the engine among a plurality of modes, the plurality of modes including at least the power mode and an economy mode for operating the engine at a lower output power than the power mode;

limiting the maximum rotation speed of the engine to the predetermined rotation speed only when the fourth signal indicates that the output mode of the engine is the power mode.

* * * * *